United States Patent [19]

Suzuki

[11] Patent Number: 4,934,210

[45] Date of Patent: Jun. 19, 1990

[54] KICK STARTER FOR VEHICLE

[75] Inventor: Kiyoharu Suzuki, Iwata, Japan

[73] Assignee: Yamaha Hatsudoki Kabushiki Kaisha, Iwata, Japan

[21] Appl. No.: 659,282

[22] Filed: Oct. 10, 1984

[30] Foreign Application Priority Data

Oct. 11, 1983 [JP] Japan ..... 58-188358

[51] Int. Cl.[5] ..... G05G 1/14

[52] U.S. Cl. ..... 74/512; 74/594.7

[58] Field of Search ..... 74/512, 560, 594.1, 74/523, 543, 545, 474, 562, 562.5, 564, 478, 478.5, 561, 594.7, 594.4, 594.5; 280/294, 291

[56] References Cited

U.S. PATENT DOCUMENTS

| | | | |
|---|---|---|---|
| 599,978 | 3/1898 | Tanner | 74/594.7 |
| 1,091,405 | 3/1914 | Trambley | 74/594.7 |
| 1,122,342 | 12/1914 | Westerberg | 74/594.7 |
| 1,276,139 | 8/1918 | Warren | 74/594.7 |
| 2,384,139 | 9/1945 | Schwinn | 74/594.7 |
| 3,422,701 | 1/1969 | Boisis | 74/594.7 |
| 3,580,607 | 5/1971 | Pletscher | 280/301 |
| 3,853,020 | 12/1974 | Clark | 74/560 |
| 4,009,623 | 3/1977 | Smith et al. | 74/512 |
| 4,030,561 | 6/1977 | Hashimoto et al. | 74/594.7 |
| 4,343,204 | 8/1982 | Hoshi et al. | 74/594.7 |

FOREIGN PATENT DOCUMENTS

| | | | |
|---|---|---|---|
| 55-148678 | 11/1980 | Japan | 74/512 |
| 58-43671 | 10/1983 | Japan | 74/512 |
| 231633 | 3/1944 | Switzerland | 74/594.1 |
| 779157 | 11/1980 | U.S.S.R. | 74/560 |

OTHER PUBLICATIONS

Product Engineering, pp. 372, 373, Aug. 1940, FIG. 36.

*Primary Examiner*—Vinh T. Luong

*Attorney, Agent, or Firm*—Ernest A. Beutler

[57] ABSTRACT

Several embodiments of improved kick starter mechanisms for vehicles wherein the starter mechanism includes a starter level that is pivotally supported about a first axis and is rotatable about the first axis to rotate a starter shaft for starting the engine. In addition, a foot pedal is carried by the starter lever and is rotatable between a direction extending transversely to the associated vehicle and longitudinally relative to the vehicle. The starter lever and foot pedal are rotatable as a unit in a direction opposite to the kick starting direction relative to the starter shaft for movement to a concealed storage position.

8 Claims, 6 Drawing Sheets

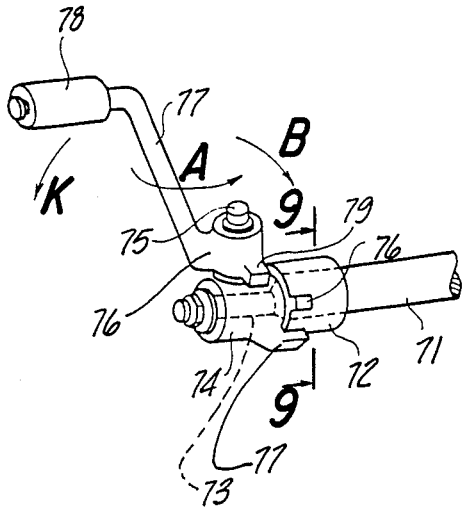
Fig-8
Fig-9
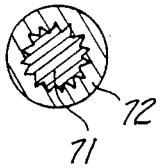
Fig-10
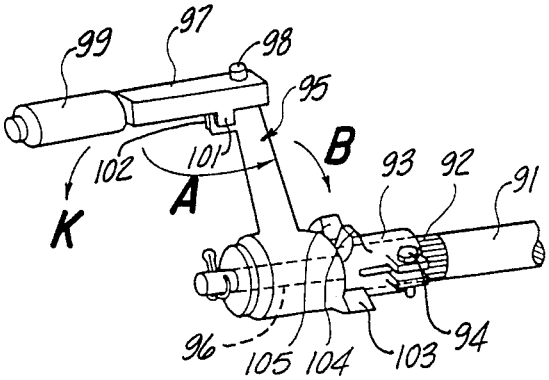

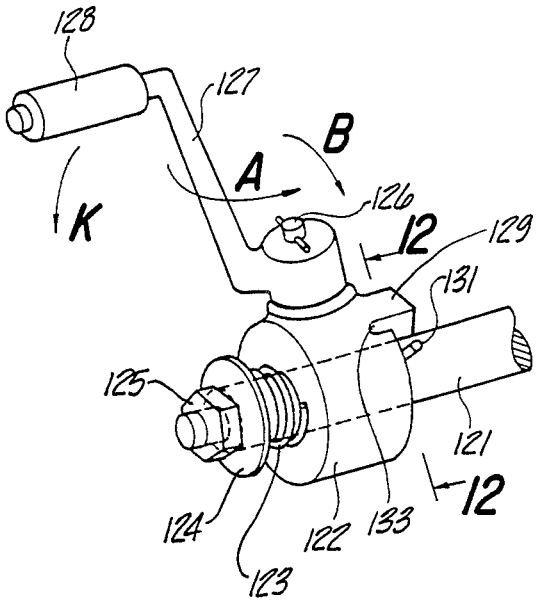
Fig-11
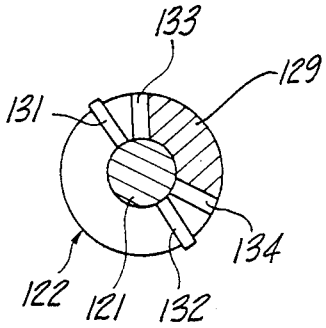
Fig-12
Fig-13
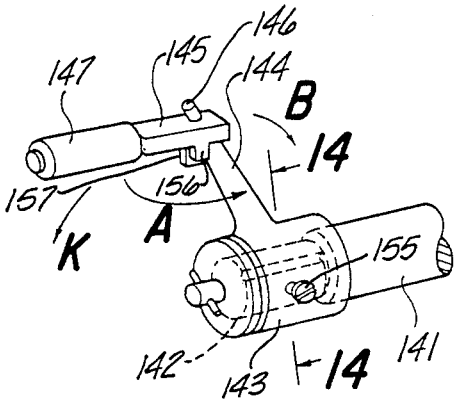
Fig-14
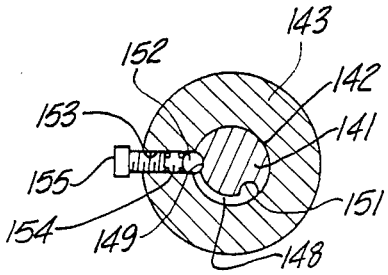

KICK STARTER FOR VEHICLE

BACKGROUND OF THE INVENTION

This invention relates to a kick starter for vehicles and more particularly to an improved kick starter arrangement.

Many types of vehicles kick starters for facilitate starting of the their internal combustion engines. Such kick starters normally include a crank arm or lever that is connected at one end to a starter shaft that interconnects with the engine crankshaft for rotating it. A foot pedal is carried by the remote end of the starter lever and is engaged by the operator's foot for starting of the engine. It has been the practice to support the foot pedal for pivotal movement so that it can be moved from an operative position to a storage position wherein it will not interfere with the normal operation of the vehicle when kick starting is not required. However, such pivotally supported foot pedals only move the pedal to an unobstructed position and frequently leave the supporting lever in a position where it may interfere with the normal operation of the vehicle. Although devices have been proposed for affording some pivotal movement of the supporting lever itself, these devices have not been acceptable in moving both the lever and its supported foot pedal for movement to a completely unobstructed location while at the same time facilitating convenient kick starting.

It is, therefore, a principal object of this invention to provide an improved kick starter for a powered vehicle.

It is another object of this invention to provide a kick starter mechanism for powered vehicles wherein the entire starter assembly may be conveniently positioned in an unobstructed storage position when not in use.

SUMMARY OF THE INVENTION

This invention is adapted to be embodied in a kick starter for a powered vehicle or the like which comprises a starter shaft that is supported for rotation about a first axis. A lever is operatively supported for rotation about the first axis from a neutral position in a first kick starting direction and in an opposite direction to a storage position. A foot pedal is carried by the lever at a point spaced from the first axis. The foot pedal is supported for pivotal movement about a second axis between a first operative position that extends substantially perpendicular to the vehicle for kick starting and a second storage position that extends substantially parallel to the vehicle for concealed storage.

BRIEF DESCRIPTION OF THE DRAWINGS

FIG. 8 is a perspective view showing another embodiment of the invention.

FIG. 9 is an enlarged cross-sectional view taken along the line 9—9 of FIG. 8.

FIG. 10 is a perspective view, in part similar to FIG. 8, showing another embodiment of the invention.

FIG. 11 is a perspective view, in part similar to FIGS. 8 and 10, showing a still further embodiment of the invention.

FIG. 12 is an enlarged cross-sectional view taken along the line 12—12 of FIG. 11.

FIG. 13 is a perspective view, in part similar to FIGS. 8, 10 and 11, showing yet another embodiment of the invention.

FIG. 14 is an enlarged cross-sectional view taken along the line 14—14 of FIG. 13.

DETAILED DESCRIPTION OF THE PREFERRED EMBODIMENTS

Figure 1:
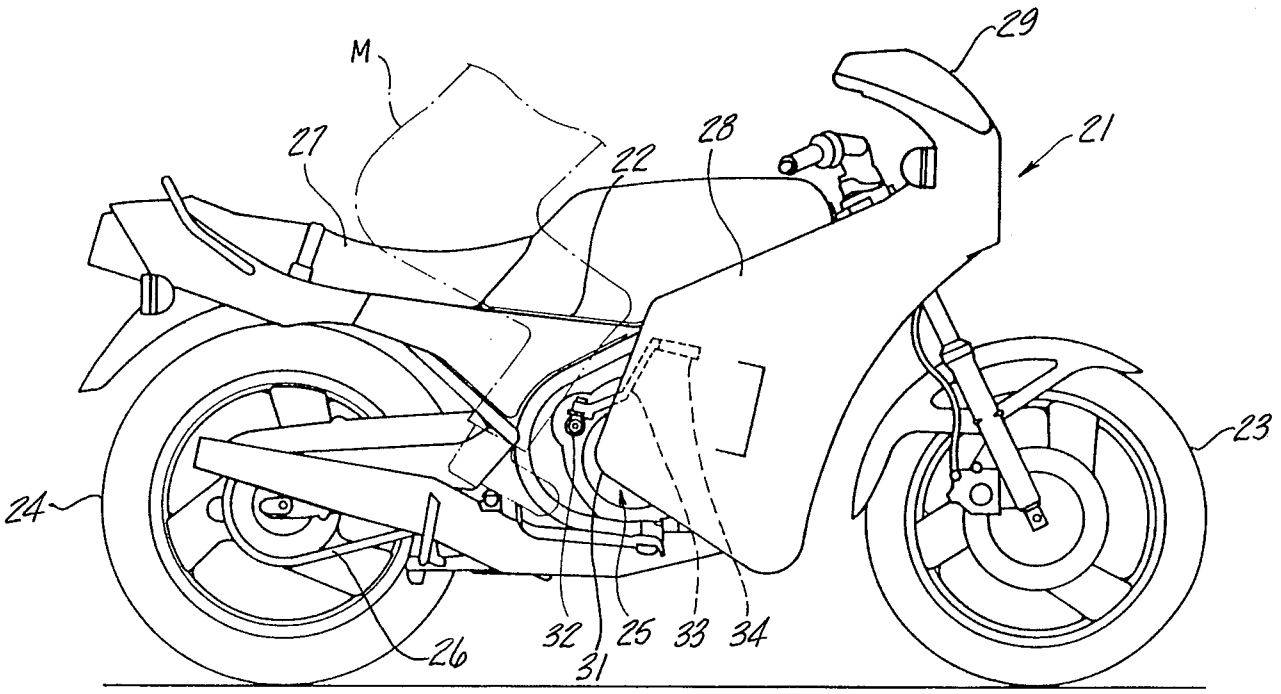
FIG. 1 is a side elevational view of a motorcycle embodying a kick starter constructed in accordance with an embodiment of the invention and showing the kick starter in its storage position.

Referring first to FIGS. 1 through 7, a motorcycle embodying a kick starter constructed in accordance with this embodiment is identified generally by the reference numeral 21. The motorcycle 21 includes a frame assembly 22 upon which a front wheel 23 is supported for steering and suspension movement. The frame assembly 22 also journals a rear wheel 24. An internal combustion engine, of any known type and which may incorporate an internal transmission assembly, is identified generally by the reference numeral 25 and drives the rear wheel 24 in a suitable manner, as by means of a driving chain 26. A seat 27 is mounted upon the frame 22 and affords accommodations for a rider, indicated by the letter M and shown in phantom in FIG. 1. A protective cowling 28 encircles the forwardmost portion of the motorcycle and mounts a windscreen 29 and has at its rear ends a pair of trailing wings or flaps 31 that partially enclose the forward portion of the engine 25. The construction as thus far described may be considered to be conventional.

The engine 25 and specifically its transmission portion rotatably journals a starter shaft 32 that is in suitable driving engagement, in a known manner, with the crankshaft of the engine 25 for rotating it in its normal direction of running upon rotation of the starter shaft 32 in a counterclockwise direction. A starter crank or lever 33 is associated with the starter shaft 32, in a manner to be described, so as to permit this kick starting. In a like manner, a foot pedal 34 is carried at the outer end of the starter lever 33 for applying a force to it from an operator's foot in a manner also to be described.

A collar assembly, indicated generally by the reference numeral 35, is provided with a splined internal opening 36 that non-rotatably couples it to a splined end 37 of the starter shaft 32. A nut and washer assembly 38 holds the collar assembly 35 on the shaft 32. The collar assembly 35 has a cylindrical outer surface 39 that journals a bore 41 of a supporting post assembly, indicated generally by the reference numeral 42. The post assembly 42 is rotatable relative to the collar assembly 35 about the same axis about which the starter shaft rotates. The degree of relative rotation between the post 42 and collar 35 is lifted in each direction, as will become apparent.

The post 42 has a radially outwardly extending bearing portion 43 that extends generally perpendicularly to the axis of rotation of the starter shaft 32. The portion 43 is received in a cylindrical bearing opening 44 of the crank-shaped starter lever 33 for journaling the starter lever 33 for rotation relative to the portion 43 about this axis. The starter lever 33 is held axially on the post 42 by a snap ring 45.

The figures of the drawings, except for FIG. 1, show the foot pedal 34 and starter lever 33 in solid line views as they appear when these elements are in position for kick starting of the engine 25. In this position, the lever 33 and foot pedal 34 are disposed so that the foot pedal 34 extends generally perpendicularly to the longitudinal axis of the motorcycle 21. The lever 33 is retained in this position by means of a detent ball 46 that is received in a bore 47 formed adjacent and below its bearing opening 44. A coil compression spring 48 is received in this bore so as to urge the detent ball 46 into engagement with a first detent recess 49 formed on the post assembly 42. The foot pedal 34 and starter lever 33 may be rotated about the post portion 43 in a direction indicated by the arrow A so as to disengage the detent ball 46 from the recess 49. This rotation is permitted until the foot pedal 34 extends generally in a longitudinal direction relative to the motorcycle 21 where it is retained by engagement of the detent ball 49 with a second detent recess 51 formed on the post assembly 42.

When the starter lever 33 and foot pedal 34 are in their operative position as maintained by the detent ball 46 engaging the detent recess 49, a lug portion 52 (FIG. 6) of the starter lever 33 engages a lug portion 53 formed on the post assembly 42. Hence, further rotation in a clockwise direction as viewed in this figure is precluded. If an operator exerts a force on the foot pedal 34 in the direction of the arrow K, the starter lever 33, post assembly 42 and bushing assembly 35 will rotate as a unit in this direction to accomplish kick starting.

Figure 7:
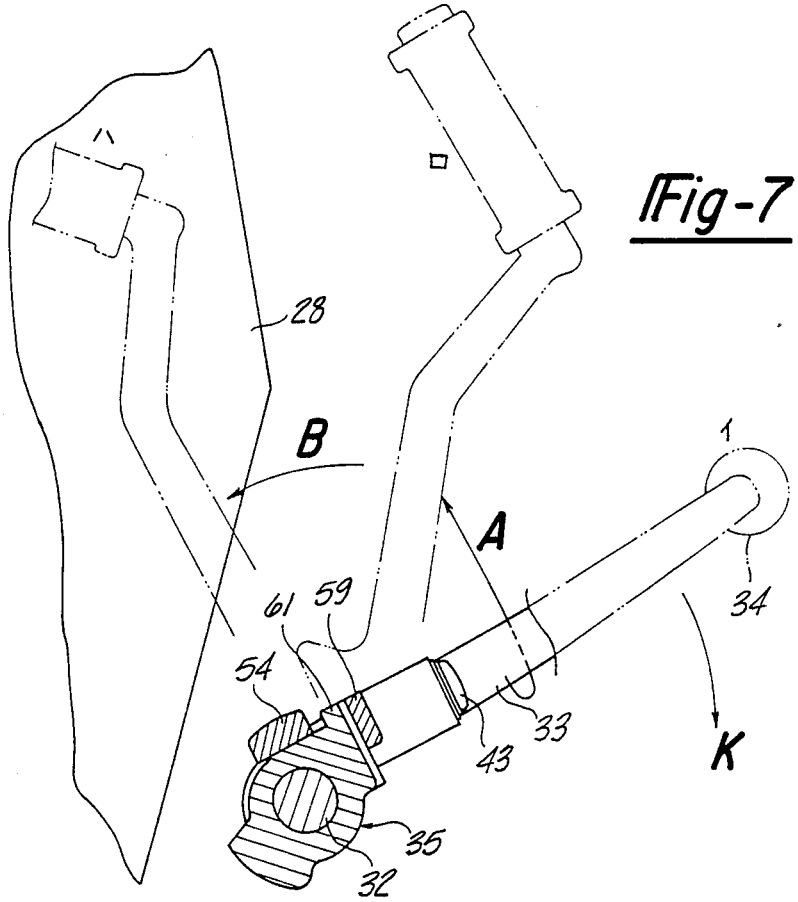
FIG. 7 is a cross-sectional view taken along the line 7—7 in FIG. 5.

The transmission of a rotational force from the starting lever 33 to the collar 35 is achieved by means of a lug 54 that is formed on the base portion of the post assembly 43 and which engages a surface of the collar 35 as shown in FIG. 7 so as to limit relative rotation of the starter lever 33 relative to the collar 35 in the clockwise direction as shown in this figure.

Figure 2:
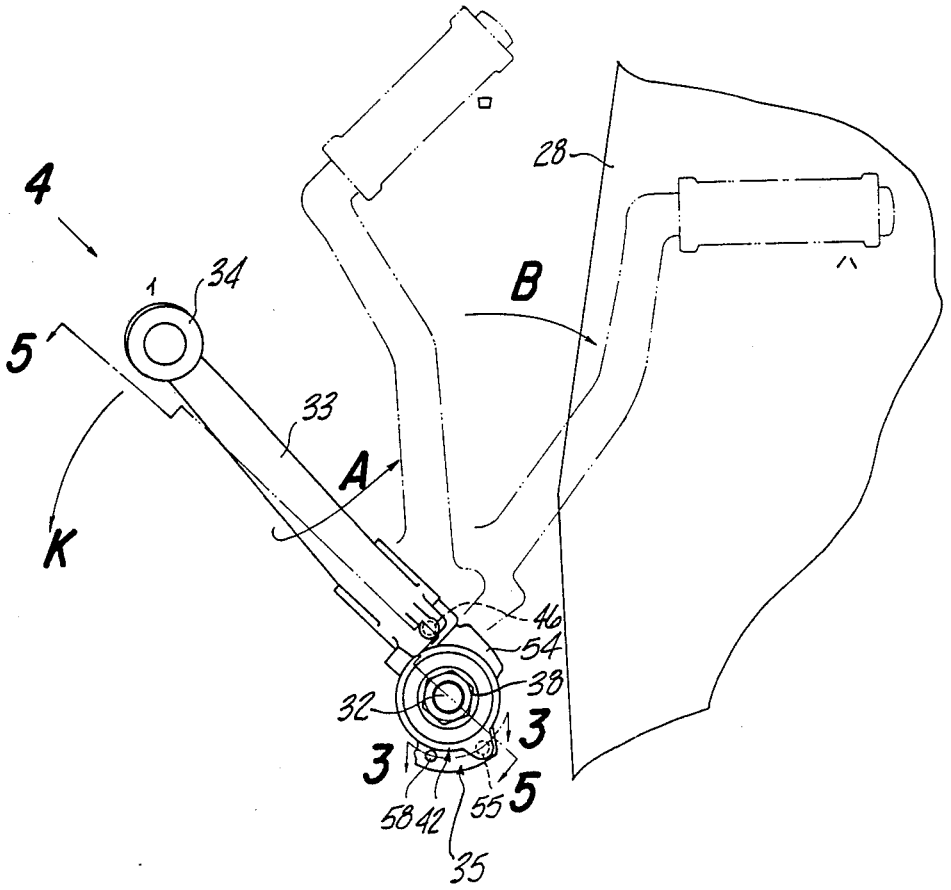
FIG. 2 is an enlarged side elevational view of the kick starter of the embodiment of this figure showing the starter in its kick starting position in a solid line view and the stages of movement of the kick starter to its storage position in phantom line views.
Figure 3:
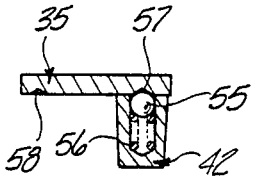
FIG. 3 is an enlarged cross-sectional view taken along the line 3—3 of FIG. 2.
Figure 4:
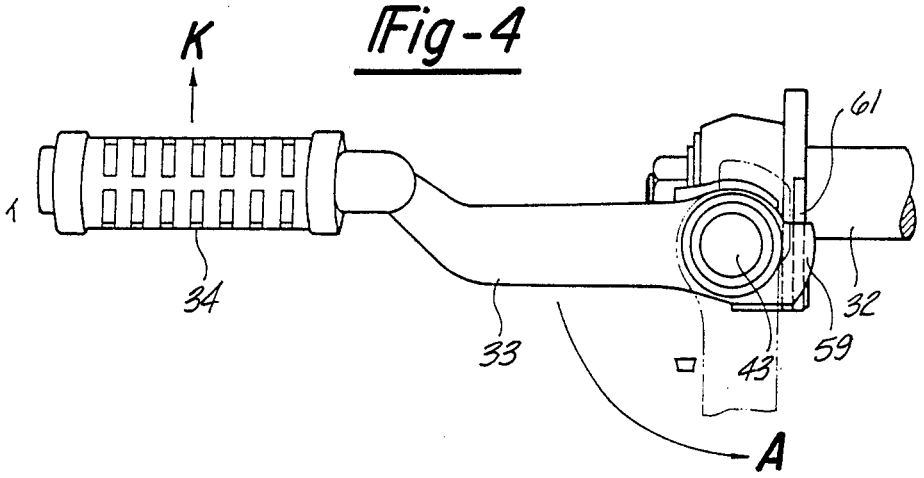
FIG. 4 is an end elevational view looking in the direction of the arrow 4 in FIG. 2.
Figure 5:
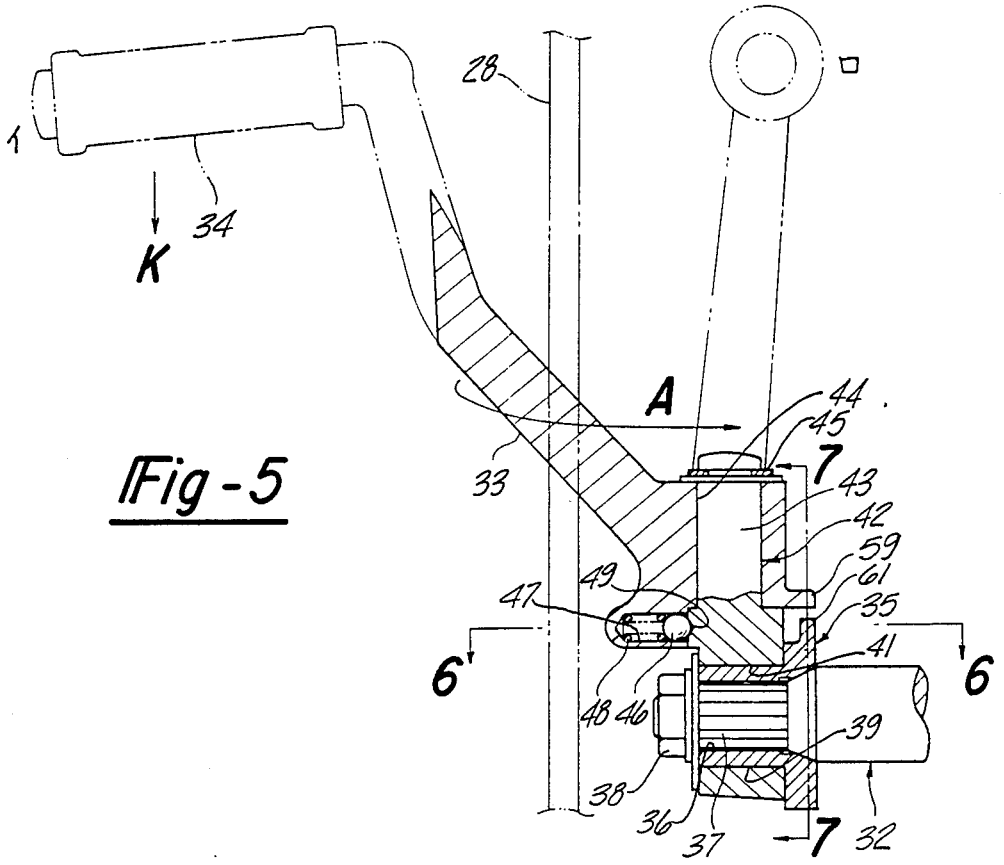
FIG. 5 is a partial cross-sectional view taken along the line 5—5 of FIG. 2.
Figure 6:
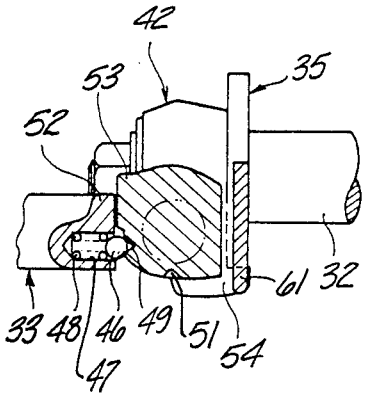
FIG. 6 is a cross-sectional view taken along the line 6—6 in FIG. 5.

When kick starting is not necessary, the starter lever 33 and foot pedal 34 may be rotated to an inoperative position about the post portion 43 by rotating it in the direction of the arrow A in the figures. In this position and as has been noted, the starter lever and specifically the foot pedal 34 will extend in the longitudinal direction relative to the motorcycle. However, the starter lever 33 may still be disposed so that it will interfere with the rider's legs and/or other components of the motorcycle. To avoid this, the foot pedal 34 and starter lever 33 are then rotated relative to the collar 35 in a clockwise direction as viewed in FIG. 2, as shown by the arrow B. At this time, a detent ball 55 that is slidably supported in a bore in the post 42 will be cammed against a spring 56 received in this bore so as to permit the detent ball 55 to move out of a recess 57 formed in the collar 35. Hence, the assembly may be rotated in a clockwise direction as seen in FIG. 2 until the detent ball 55 mates with a further recess 58 formed in the collar 35 so as to then retain the starting lever 33 and the foot pedal 34 in their storage position. In this position, a major portion of the lever 33 and the foot pedal 34 will be positioned behind the rings 31 of the cowling 28 so as to be clear of the airstream and free of interference with the operator.

It should be readily apparent that the described construction permits the starter lever 33 and foot pedal 34 to be rotated about the axis of the starter shaft 32 in the direction of the arrow K for kick starting. In addition, the starter lever 33 may be rotated in the opposite direction (arrow B) to a storage position. However, in this embodiment, before this can be done, the starter lever 33 and foot pedal 34 must be rotated about the axis defined by the post 43 in the direction of the arrow A. A lug 59 is formed on the starter lever 33 and is adapted to engage a cam surface 61 that is formed on the collar 35 so as to prevent rotation of the starter lever 33 in the direction of the arrow B until it has first been rotated in the direction of the arrow A from its operative position to its intermediate storage position.

Another embodiment of the invention is illustrated in FIGS. 8 and 9. In this embodiment, only the starter lever, foot pedal and association with the starter shaft have been illustrated and will be described. It should be understood that the association of these elements with the remaining components of the motorcycle may be the same as in the embodiment of FIGS. 1 through 7.

Referring now specifically to this embodiment, a starter shaft 71 has a splined end on which a collar 72 is non-rotatably received. Either the collar 72 or the starter shaft 71 is provided with a coaxial extension 73 on which a post assembly 74 is journaled for rotation. The post assembly 74 is rotatable relative to the shaft 71 and sleeve 72 to a limited extent in either direction, as will become apparent.

The post assembly 74 has an integral post portion 75 that journals a bushing portion 76 of a starter lever 77. The starter lever 77 carries a foot pedal 78 at its outer end.

The collar 72 is provided with a lug 76 that is adapted to be engaged by a corresponding lug 77 formed on the post assembly 74 for effecting rotation of the starter shaft 71 upon rotation of the post 74 in the direction of the arrow K.

In this embodiment, like the embodiment of FIGS. 1 through 7, the starter lever 77 and foot pedal 78 may be moved to a storage position by first rotating the lever 77 and attached pedal 78 about the post portion 75 in the direction of the arrow A. When the lever 77 has been rotated sufficiently so that the foot pedal 78 extends longitudinally of the motorcycle, the assembly may be rotated about the axis of the starter shaft 71 in the direction of the arrow B inasmuch as the post assembly 74 is rotatably journaled on the extension of the shaft 71, as has been previously noted. This rotation will continue until a lug 79 on the lever 77 comes into engagement with the lug 76 on the collar 72 so as to preclude further rotation in this direction. At this point, the starter lever 77 and foot pedal 78 will be in their storage positions.

Another embodiment of the invention is illustrated in FIG. 10. In this embodiment, like the embodiment of FIGS. 8 and 9, the construction of the motorcycle is the safe and thus only the starter shaft, starter lever and foot pedal have been illustrated and will be described. In this embodiment, like the previous embodiments, a starter shaft 91 is journaled for rotation about a first axis and is coupled to the crankcase of the associated engine in an appropriate manner for starting of the engine upon rotation. The starter shaft 91 has a splined end 92 on which an internally splined collar 93 is non-rotatably fixed by means including a clamping bolt 94.

A starter lever, indicated generally by the reference numeral 95, is journaled on a projecting portion 96 of the starter shaft 91 for rotation relative to the starter shaft 91 about the rotational axis of the starter shaft. Unlike the previously described embodiments, the starter lever 95 is formed of two pieces, the main portion which is journaled on the shaft 96 and a second foot pedal supporting portion 97 is pivotally connected to the portion 95 by means of a pivot pin 98, which may be formed integrally with the portion 95. The pivot pin 98 permits rotation of the foot pedal supporting portion 97 about an axis that is generally perpendicularly disposed to the axis of rotation of the starter shaft 91. A foot pedal 99 is carried at the outer end of the portion 97.

The starter lever portion 97 has a lug 101 that engages a corresponding lug 102 formed on the portion 95 so that when a kicking force is exerted in the direction of the arrow K, the starter lever portion 95 will rotate in a counterclockwise direction relative to the starter shaft 91. At this time, a lug 103 formed on the base portion of the starter lever portion 95 will contact a lug 104 on the collar 95 so as to rotate the starter shaft 91 in a starting direction.

When it is desired to rotate the starter mechanism to its storage, non-operative position, the starter lever portion 97 and foot pedal 99 are rotated in the direction of the arrow A about the pivot pin 98 so that the portion 97 and foot pedal 99 extend in a generally longitudinal direction relative to the motorcycle. The combined assembly is then rotated in the direction of the arrow B until a further lug 105 on the starter lever portion 95 engages the lug 104 on the collar 93 at which time the starter mechanism will be in its storage position, as with the previously described embodiments.

A still further embodiment of the invention is illustrated in FIGS. 11 and 12. Like the embodiments of FIGS. 8 and 9 and of FIG. 10, only the starter shaft and the mechanism for rotating it is illustrated in the figures. A starter shaft 121 is supported for rotation in a suitable manner and is coupled to the engine crankshaft for starting it. A sleeve 122 is rotatably journaled on the exposed end of the starter shaft 121 and is axially slidable relative to it, for a reason to be described. A coil compression spring 123 encircles the outer end of the shaft 121 and is loaded between the sleeve 122 and a washer 124 that is held on the shaft 121 by a nut 125. The spring 123 normally urges the collar 122 in an axially inward direction, for a reason to be described.

The sleeve 122 has a radially extending pivot pin 126 that journals the inner end of a crank-shape starter lever 127. The starter lever 127 is rotatable about an axis defined by the pin 126, which axis extends generally radially with respect to the axis of rotation of the starter shaft 121. A foot pedal 128 is affixed to the outer end of the starter lever 127 for applying starting forces to it.

The collar 122 is provided with an axially inwardly extending lug 129 that is received between a pair of pins 131 and 132 that are staked to the starter shaft 121 and which form a lost motion connection between the collar 122 and the starter shaft 121. Adjacent the opposite sides of the lugs 129, the collar 122 is formed with respective recesses 133 and 134.

When it is desired to kick start the engine, the collar 122 will have been rotated so that the pin 132 is aligned with the recess 134. The action of the spring 123 will cause the collar to move axially so that the pin 132 enters into the recess 134 and is engaged with the lug 129. Kicking forces applied to the foot pedal 128 in the direction of the arrow K will, therefore, effect rotation of the starter shaft 121 for effecting kick starting.

When it is desired to move the starter mechanism to its inoperative, storage position, the starter lever 127 and foot pedal 128 are first rotated in the direction of the arrow A about the pivot pin 126. This will be assisted since the spring 123 and the cooperation of the pin 132 and the recess 134 will tend to prevent rotation of the collar 122. When the lever 127 and foot pedal 128 have been rotated so that the foot pedal 128 extends longitudinally of the motorcycle, the combined assembly is rotated in a direction indicated by the arrow B relative to the starter shaft 121. Preferably, the recesses 134 and 133 are configured so as to act as detents and permit the collar 122 to be cammed axially so that the rotation in the direction of the arrow B may be accomplished. Alternatively, the operator may pull the collar 122 in an axial direction. The rotation in the opposite direction from kick starting (rotation in the direction of the arrow B) is continued until the pin 132 enters the recess 133 and then the starter mechanism will be retained in its storage, inoperative position. Of course, the device can be returned to the starting position through rotation first in the direction of the arrow K and then in the direction opposite to the arrow A.

Yet another embodiment of the invention is shown in FIGS. 13 and 14. As with the embodiments of FIGS. 8 and 9, FIG. 10, and FIGS. 11 and 12, only the starter shaft and the mechanism associated with it have been illustrated. In this embodiment, a starter shaft 141 is rotatably supported about an axis and is coupled to the engine crankshaft in a suitable manner. The starter shaft 141 has a reduced diameter end portion 142 upon which a collar 143 is journaled. The collar 143 is fixed axially relative to the starter shaft 141 and carries an integral starter lever portion 144.

A starter lever portion 145 is journaled on the starter lever shaft portion 144 by means of a pivot pin 146 for rotation about an axis that extends generally radially relative to the axis of rotation of the starter shaft 141. A foot pedal 147 is formed on the outer end of the lever portion 145.

The starter shaft portion 142 is formed with a cylindrical recess 148 that terminates in first and second detent recesses 149 and 151. A detent ball 152 is received in a bore 153 in the collar 143 and is urged into engagement with the recess 148 and detent recesses 149 and 151 formed at the end of recess 148 by means of an elastomer spring 154. A bolt or screw 155 preloads the elastomer spring 154 in a known manner.

As with the previously described embodiments, the engine may be started by applying a kicking force to the foot pedal 147 in the direction of the arrow K. When this occurs, a lug 156 formed on the starter lever portion 145 engages a corresponding lug 157 formed on the starter lever portion 144 so as to exert a rotational force in the direction of the arrow K on the collar 153. At this time, the detent ball 152 will be received in the recess 149 so as to couple the collar 143 rotatably with the starter shaft 141 and rotate it in a corresponding direction.

The mechanism may be storage in an inoperative storage position by rotating the foot pedal 147 and starter lever portion 145 about the pivot pin 146 so that these elements extend in a longitudinal direction relative to the motorcycle. The combined assembly including the collar 143 and starter lever portion 144 may then be rotated in the direction of the arrow B. This is achieved by camming of the detent ball 152 out of the recess 149 against the action of the elastomer spring 154. This rotation continues until the device is in its storage position and the detent ball is urged by the spring 154 into the recess 151 so as to retain the starter mechanism in its stored, inoperative position.

It should be readily apparent from the foregoing description that a number of embodiments of the invention have been illustrated and described, each of which achieves an effective starter mechanism that can be conveniently rotated and moved into a storage position wherein it will not interfere with the operation of the motorcycle or associated vehicle. Although a number of embodiments have been illustrated and described, various charges and modifications may be made, without departing from the spirit and scope of the invention, as defined by the appended claims.

I claim:

1. A kick starter for a powered vehicle comprising a starter shaft for rotation about a first axis, a lever operatively supported for rotation about said first axis from a neutral position in a first kick starting direction and in an opposite direction to a storage position, a foot pedal carried by said lever at a point spaced from said first axis, and means for supporting said foot pedal for pivotal movement about a second axis between a first, operative position extending substantially perpendicular to said vehicle for kick starting and to a second, storage position extending substantially longitudinally to the vehicle for concealed storage.

2. A kick starter as set forth in claim 1 wherein the vehicle has a panel adapted to conceal the foot pedal when the foot pedal is rotated from its first position to its second position while the lever is in its neutral position and whereupon the lever is moved from its neutral position to its storage position.

3. A kick starter as set forth in claim 2 further including means for precluding rotation of the starter shaft about one of the axes until the starter shaft has been rotated first about the other axis.

4. A kick starter as set forth in claim 1 further including stop means for limiting the degree of rotation of the lever about the first axis in the storage direction.

5. A kick starter as set forth in claim 1 wherein the lever is operatively connected to the starter shaft by means of a lost motion connection for permitting a degree of angular rotation of the lever relative to the starter shaft from the neutral position in the opposite direction.

6. A kick starter as set forth in claim 1 wherein the foot pedal is pivotally supported by the lever for movement about the second axis.

7. A kick starter as set forth in claim 6 further including lost motion connection means between the foot pedal and the lever for limiting the degree of pivotal movement of the foot pedal relative to the lever in a direction.

8. A kick starter as set forth in claim 1 wherein the foot pedal and lever are supported jointly for rotation about the second axis.

* * * * *